US007100325B2

(12) United States Patent
Ichinose

(10) Patent No.: US 7,100,325 B2
(45) Date of Patent: Sep. 5, 2006

(54) SAFETY SLIDING DOOR APPARATUS

(75) Inventor: Mikio Ichinose, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 54 days.

(21) Appl. No.: 10/814,637

(22) Filed: Apr. 1, 2004

(65) Prior Publication Data

US 2004/0194385 A1 Oct. 7, 2004

(30) Foreign Application Priority Data

Apr. 7, 2003 (JP) ..... 2003-103070

(51) Int. Cl.
*E05D 15/48* (2006.01)

(52) U.S. Cl. ..... 49/168; 296/155; 49/26; 49/28; 49/163; 49/360

(58) Field of Classification Search ..... None
See application file for complete search history.

(56) References Cited

U.S. PATENT DOCUMENTS

| | | | | |
|---|---|---|---|---|
| 5,039,925 | A | 8/1991 | Schap | |
| 6,135,513 | A * | 10/2000 | Hamada et al. | 292/201 |
| 6,477,806 | B1 * | 11/2002 | Asada et al. | 49/169 |
| 6,513,285 | B1 * | 2/2003 | Isomura | 49/351 |
| 6,848,216 | B1 * | 2/2005 | Engelgau et al. | 49/360 |
| 6,925,755 | B1 * | 8/2005 | Kyrtsos | 49/26 |
| 2003/0116995 | A1 * | 6/2003 | Yogo et al. | 296/155 |
| 2004/0070231 | A1 * | 4/2004 | Yogo et al. | 296/155 |
| 2004/0189045 | A1 * | 9/2004 | Yoshida et al. | 296/155 |
| 2004/0256883 | A1 * | 12/2004 | Ichinose et al. | 296/155 |

FOREIGN PATENT DOCUMENTS

| | | | |
|---|---|---|---|
| JP | 63-81173 | U | 5/1988 |
| JP | 7-1961 | A | 1/1995 |
| JP | 11-36710 | A | 2/1999 |
| JP | 11-270229 | A | 10/1999 |
| JP | 2000-240352 | A | 9/2000 |
| JP | 2001-173296 | A | 6/2001 |
| JP | 3263805 | B2 | 12/2001 |
| JP | 2002-89133 | A | 3/2002 |
| JP | 2002-350104 | A | 12/2002 |
| JP | 2003-25848 | A | 1/2003 |

* cited by examiner

*Primary Examiner*—Jerry Redman
(74) *Attorney, Agent, or Firm*—Sughrue Mion, PLLC

(57) ABSTRACT

A sliding door apparatus includes a sliding door having a window and slidably disposed with respect to a body of a vehicle, a foreign object detecting unit that detects whether a foreign object exists in the open area, and a slide stopping unit that stops, upon the foreign object detecting unit detecting existence of the foreign object, sliding of the sliding door in the opening direction before the sliding door reaches a full-open position.

13 Claims, 5 Drawing Sheets

SAFETY SLIDING DOOR APPARATUS

BACKGROUND OF THE INVENTION

1) Field of the Invention

The present invention relates to a sliding door apparatus with a window where an opening/closing member such as a window glass is disposed so as to allow opening or closing of the window.

2) Description of the Related Art

In a sliding door apparatus having a window where an opening/closing member such as a window glass is disposed so as to allow opening/closing of the window, when the sliding door is slid in an opening direction with the window open, the opened area of the window is gradually narrowed because it is overlapped with a body of a vehicle. Therefore, in case someone sticks his or her head or hand out of the window when the window is open, it is possibly caught in the window while the slide door is opened.

One of the conventional sliding door apparatuses of this kind solves the above problem by adopting a mechanism to stop the sliding door before it reaches a full-open position if opening operation of the sliding door is made when opening of the window exceeds a certain level, for example, when the window is opened more than 150 millimeters, (See, for example Japanese Patent Application Laid-Open Publication JP-A 2000-240352).

However, even when the opening of the window is not more than a predetermined level (hereinafter, "a threshold"), it is possible to stick a hand or a long narrow object out of the window, so that there is still a possible danger that the hand or the object is caught between the window and the body of the vehicle.

Of course, it is possible to prevent the foreign object from being caught more securely by setting the threshold smaller. However, when the threshold is set smaller, it is impossible to fully open the sliding door unless the window opening is smaller than the threshold or even closed, which significantly causes an inconvenience when handling the sliding door apparatus. In particular, when the user does not notice that the window is slightly open, or does not recognize the closing function itself, it is difficult to figure out the reason why the full open of the sliding door is disabled.

SUMMARY OF THE INVENTION

It is an object of the present invention to solve at least the problems in the conventional technology.

The sliding door apparatus according to one aspect of the present invention includes a sliding door having a window and slidably disposed with respect to a body of a vehicle, a foreign object detecting unit that detects whether a foreign object exists in an open area of the window, and a slide stopping unit that stops, upon the foreign object detecting unit detecting existence of the foreign object in the open area, sliding of the sliding door in an opening direction before the sliding door reaches a full-open position.

The other objects, features, and advantages of the present invention are specifically set forth in or will become apparent from the following detailed descriptions of the invention when read in conjunction with the accompanying drawings.

DETAILED DESCRIPTION

Exemplary embodiments of a sliding door apparatus according to the present invention will be explained in detail with reference to the accompanying drawings.

Figure 1A:
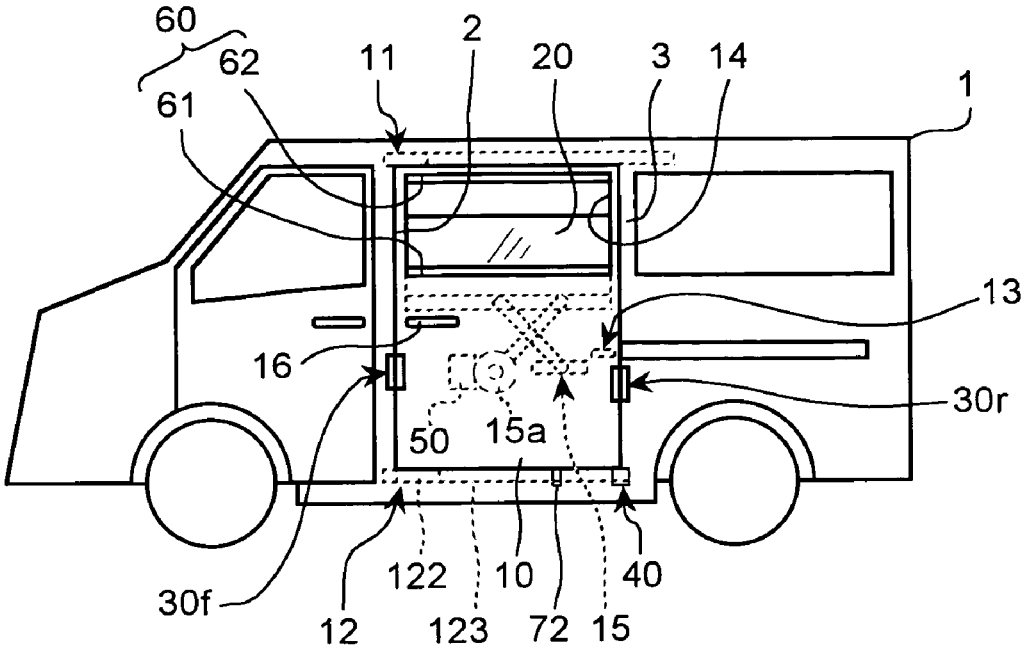
FIG. 1A to FIG. 1C are schematics of a vehicle that employs a sliding door apparatus according to an embodiment of the present invention: a side view of the sliding door in a closed position (FIG. 1A); a side view of the sliding door in a condition that slide stopping unit is activated (FIG. 1B); and a side view of the sliding door in a full-open position (FIG. 1C)
Figure 1B:
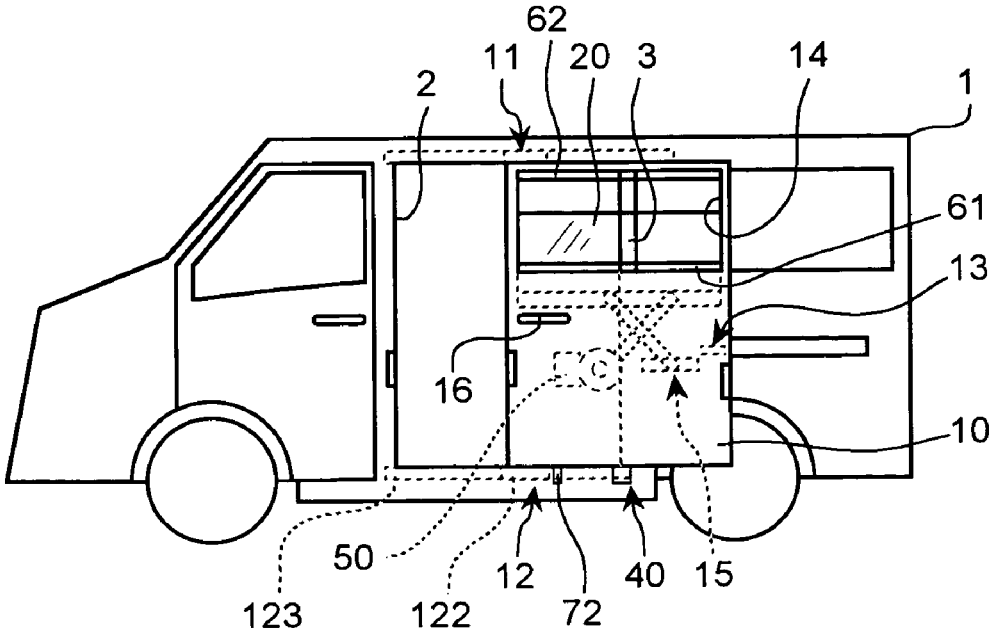
Figure 1C:
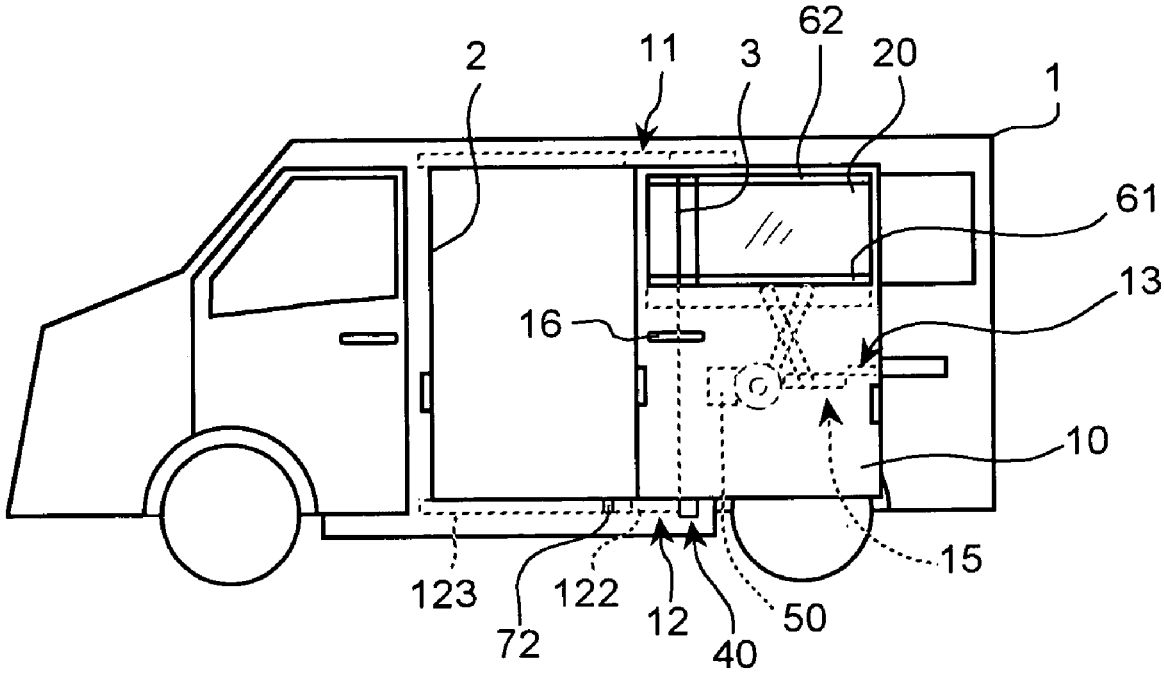

FIG. 1A to FIG. 1C are schematics of a vehicle that employs a sliding door apparatus according to an embodiment of the present invention. The vehicle has a body 1 of a one-box type, an entrance opening 2, which allows passengers to get on or off the vehicle, disposed at substantially center of a side of the body 1, and a sliding door 10 provided at the entrance opening 2.

Figure 2A:
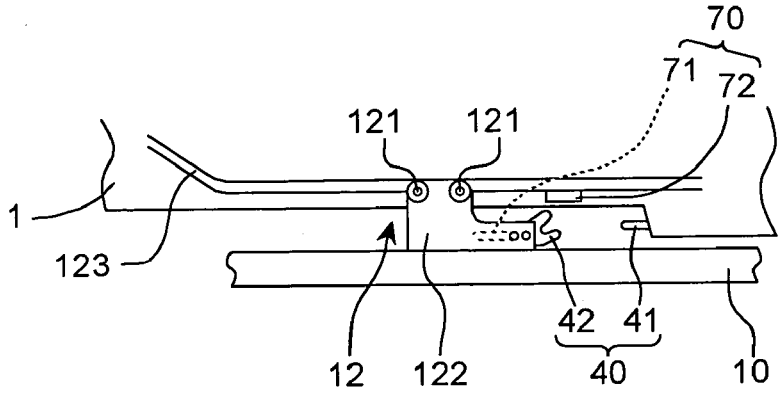
FIG. 2A to FIG. 2C are partial views of the sliding door apparatus: in a slightly-opened position (FIG. 2A); in the condition that the slide stopping unit is activated (FIG. 2B); and in the full-open position (FIG. 2C)
Figure 2B:
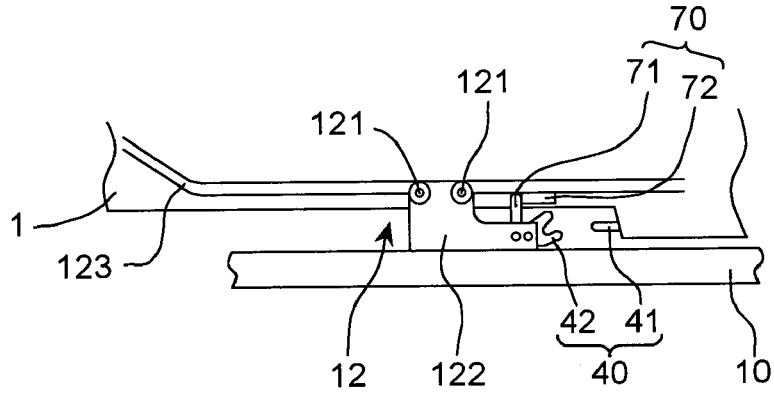
Figure 2C:
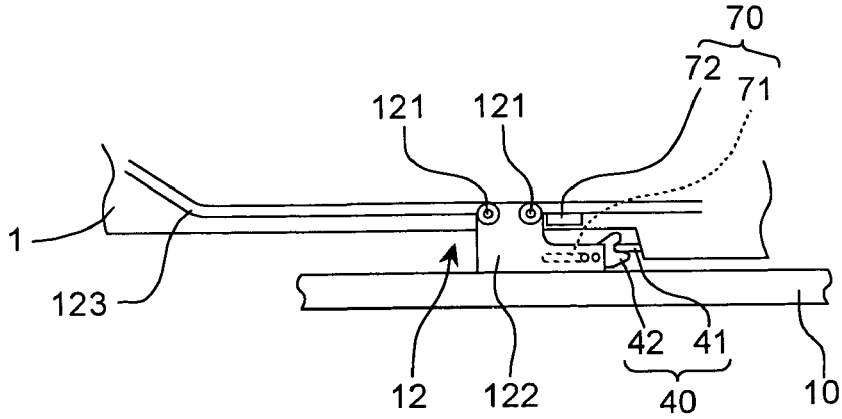

The sliding door 10 is slidably disposed in a lateral direction of the body 1 using an upper guiding means 11 arranged at an upper side of the body 1, a lower guiding means 12 arranged at a lower side of the body 1, and a center guiding means 13 arranged at a center part of the body 1. The sliding door 10 closes the entrance opening 2 when slid to front most of the body 1 as shown in FIG. 1A (hereinafter, "a closed position"), while it opens the entrance opening 2 when slid to the backrest of the body 1 as shown in FIG. 1C (hereinafter, "a full-open position"). The guiding means are arranged by providing the sliding door 10 with a support frame 122 having a running roller 121 and providing the body 1 with a guide rail 123 for guiding the running roller 121, as shown in FIG. 2A to FIG. 2C.

The sliding door 10 includes a window glass 20 serving as an opening/closing member. The window glass 20 is for opening or closing a window opening 14, and a state of the window opening 14 is adjusted by operation of a window driving mechanism 15 provided in the sliding door 10. The present embodiment employs a power window having an open/close switch (not shown) for operating the window driving mechanism 15. The window glass 20 closes the window by rotation of the window motor 15*a* with an UP operation of the open/close switch, and opens the window with a DOWN operation of the open/close switch.

A door closing unit 30*f*, 30*r* and a full-open holding unit 40 is disposed between the sliding door 10 and the body. The door closing unit 30*f*, 30*r* is for keeping the sliding door 10 in the closed position, provided at two locations, between a front edge of the sliding door 10 and the body 1, and between a rear edge of the sliding door 10 and the body 1. The full-open holding unit 40 is for keeping the sliding door 10 in the full-open position, provided between the support frame 122 and the body 1.

In the present embodiment, the door closing unit 30*f*, 30*r* and the full-open holding unit 40 include a striker 41 and a latch 42, provided on the body 1 and on the sliding door 10, respectively, so that the sliding door 10 is kept at a desired position relative to the body 1 when the striker 41 and the latch 42 are engaged with each other. Operating of a door handle 16 releases the striker 41 of the door closing unit 30*f*, 30*r* and the full-open holding unit 40 from the latch 42 to allow the sliding door 10 to slide in either direction. If the sliding door 10 is configured to slide in the opening direction or closing direction based on an operation of a door switch provided at driver seat, passenger seat or operation of a key, the engagement between the striker 41 and the latch 42 is released when the door switch or the key is operated.

The sliding door 10 further includes a window opening state detecting unit 50 and a foreign object detecting unit 60, as well as a slide stopping unit 70.

The window opening state detecting unit 50 detects a state of the window opening 14 based on a position of the window glass 20. In the present embodiment, the state of the window opening 14 is detected by calculating amount and direction of rotation of the window motor 15*a* based on an output pulse from a rotary encoder (not shown) of the window motor 15*a*. A result of the detection is sent to an opening/closing control unit 100.

The foreign object detecting unit 60 detects whether a foreign object exists in an open area of the window opening 14. In the present embodiment, the foreign object detecting unit 60 includes a group of light emitting elements 61 provided at a bottom edge of the window opening 14 and a group of light detecting elements 62 provided at a top edge of the window opening 14. The foreign object is detected based on a change in a light intensity at the light detecting element group 62. A result of the detection is sent to the opening/closing control unit 100.

The slide stopping unit 70 blocks, when it is activated before the sliding door 10 reaches the full-open position, sliding of the sliding door 10. In the present embodiment, the slide stopping unit 70 employs a structure shown in FIG. 2A to FIG. 2C. A stopper member 71 is pivotably provided at the supporting frame 122 of the lower guiding means 12, and an abutting portion 72 is provided on the body 1. When the slide stopping unit 70 is not activated, the stopper member 71 is kept at a retracted position as shown in FIG. 2A and FIG. 2C so that it does not block the sliding of the sliding door 10. On the other hand, if the slide stopping unit 70 is activated, the stopping member 71 is set to an protruded position by an actuator (not shown) when the sliding door 10 is slid in the opening direction, the stopper member 71 gets stuck on the abutting portion 72 of the body 1, thereby preventing the sliding door 10 from further sliding. The position of the stopper member 71 and the abutting portion 72 abut is set so that a safe distance between a front side frame of the window opening 14 and a pillar 3 of the body 1 is ensured before the sliding door 10 reaches the full-open position as shown in FIG. 1B.

Figure 3:
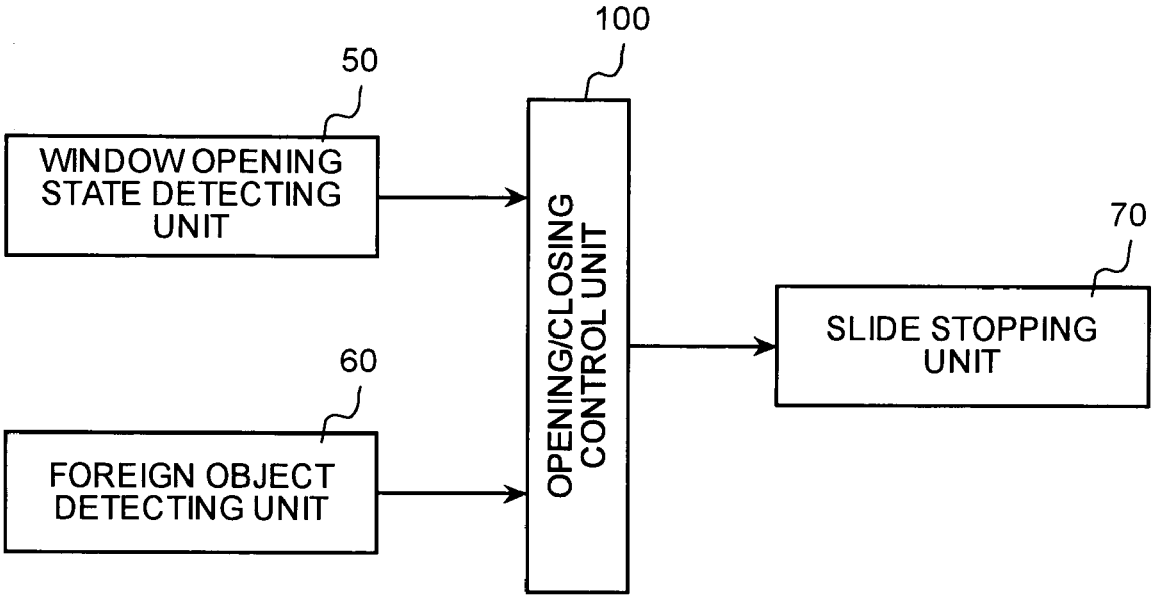
FIG. 3 is a block diagram of an opening/closing control system.

FIG. 3 is a block diagram of an opening/closing control system in the vehicle shown in FIG. 1A to FIG. 1C. The opening/closing control unit 100 controls operation of the slide stopping unit 70 based on the results of the detection by the window opening state detecting unit 50 and the foreign object detecting unit 60.

Figure 4:
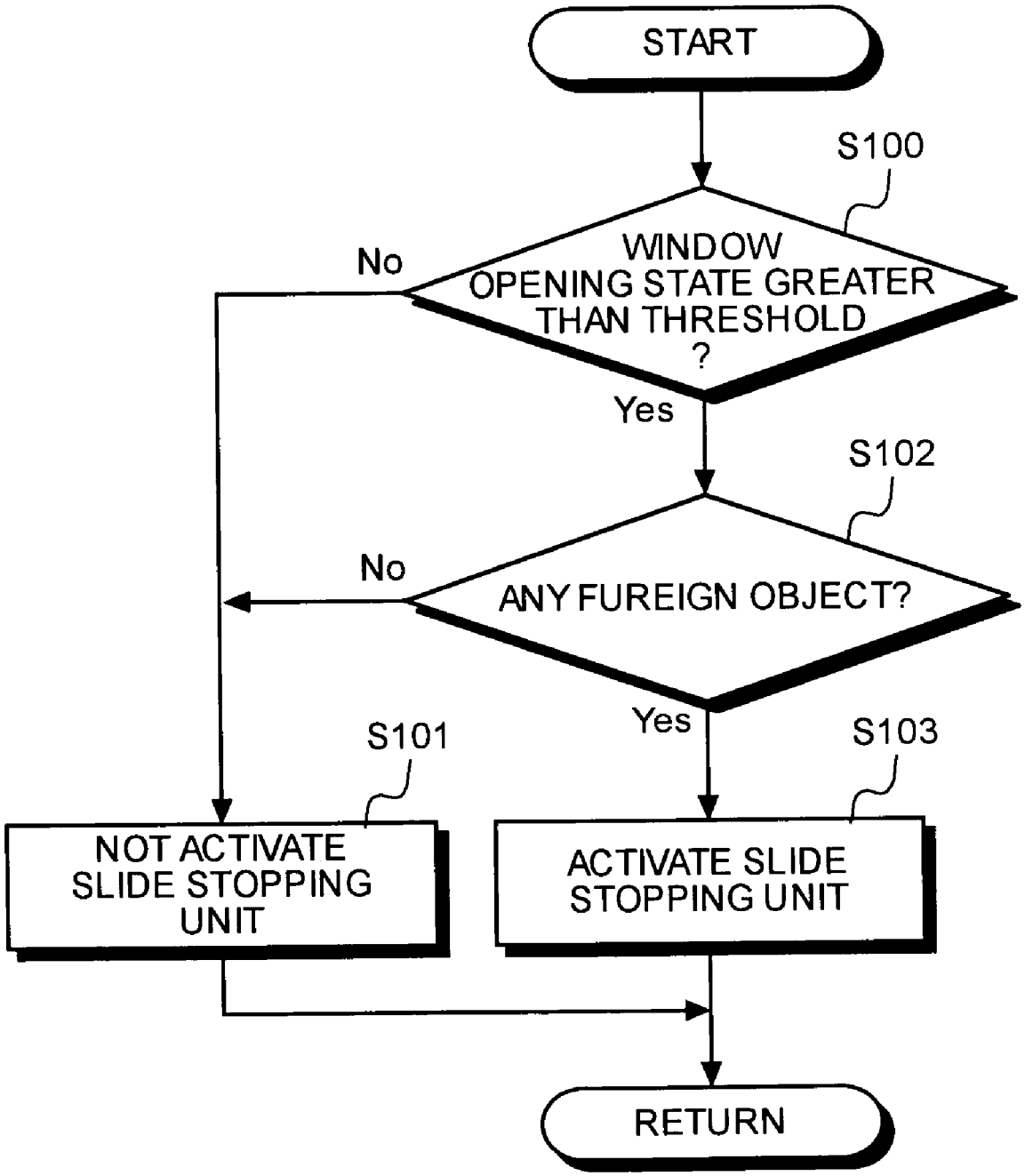
FIG. 4 is a flowchart of a process procedure of the opening/closing control unit.

FIG. 4 is a flowchart of a processing procedure of the opening/closing control unit 100. The opening/closing control unit 100 constantly monitors the result of the detection by the window opening state detecting unit 50 and determines whether state of the window opening 14 exceeds a threshold (step S100). The threshold is a criterion for the determination, and is preferably as small as possible (for example, 0 millimeter).

When the state of the window opening 14 detected by the window opening state detecting unit 50 is 0 mm, that is, the window opening 14 is closed, the opening/closing control unit 100 keeps the slide stopping unit 70 non-activated (step S101). When the slide stopping unit 70 is not activated, since the stopper member 71 is held at the retracted position, the stopper member 71 and the abutting portion 72 do not abut with each other while the sliding door 10 is slid to any position. Therefore, as shown in FIG. 2A, when the sliding door 10 is in the fully-closed position, by disengaging the striker 41 of the door closing unit 30*f*, 30*r* and the latch 42, it is possible to slide the sliding door 10 to full-open position. As a result, the entrance opening 2 of the body 1 becomes open wide as shown in FIG. 2C, which facilitates passengers' getting on or off of the vehicle and taking baggage in or out.

On the other hand, when the state of the window opening 14 detected by the window opening state detecting unit 50 exceeds 0 millimeter (which means the window opening 14 is open), the opening/closing control unit 100 checks whether a foreign object exists in the open area of the window opening 14 via the foreign object detecting unit 60 (step S102).

When there is no foreign object in the open area of the window opening 14, the process of the opening/closing control unit 100 moves to step S101 to keep the slide stopping unit 70 non-activated.

When a hand, a head or an any object is stuck out of the open area of the window opening 14 in step S102, and is detected by the foreign object detecting unit 60, the opening/closing control unit 100 switches the slide stopping unit 70 into the activated state (step S103). Once the slide stopping unit 70 is brought into the activated state, the stopper member 71 is held in the protruded position, and when the sliding door 10 is slid in the opening direction, the stopper member 71 gets stuck on the abutting portion 72 of the body 1. As a result, as shown in FIG. 2B, sliding of the sliding door 10 is blocked at the position where a predetermined safe distance is ensured between the front side frame of the opened window opening 14 and the pillar 3 of the body 1. In this manner, it is possible to prevent a foreign object from being caught between the window opening 14 and the body 1 when opening the sliding door 10.

After the sliding door 10 is stopped before reaching the full-open position, if the foreign object existing in the open area of the window opening 14 is removed, the flow moves to step S101 from step S102, and the sliding door 10 is allowed to slide to the full-open position again.

Then the opening/closing unit 100 repeats the above processing, and activates the slide stopping unit 70 so as to block sliding of the sliding door 10 in the opening direction only when existence of a foreign object in the open area of the window opening 14 is detected.

Therefore, even in the condition that the window opening 14 is open, when there is no foreign object in the open area of the window opening 14, that is, there is no possible danger that a foreign object is caught, it is possible to slide the sliding door 10 to the full-open position as is the usual case, so that usability of the sliding door apparatus is significantly improved. On the other hand, when there is a foreign object, the sliding door 10 is not allowed to slide to the full-open position even though the open area of the window opening 14 is very small, so that it is possible to securely prevent the foreign object from being caught.

In the present embodiment, although a sliding door apparatus for opening or closing the entrance opening 2 disposed at the center of the side of the body 1 of the one box type is described as an example, the present invention may be applied for opening/closing an opening provided in any other type of vehicle without being limited to the opening provided on the side of the vehicle. Likewise although the window glass 20 that opens or closes by rotation of the window motor 15*a* in response to operation of the open/close switch is described as an example of the opening/closing member, the opening/closing member does not necessarily be a glass, or does not necessarily be driven by a motor. It may be implemented by any other members that can open or close the window opening 14, and the direction of the operation is not limited to the vertical direction. Furthermore, although the window opening state detecting unit 50 detects the state of the window opening 14 based on the output pulse from the rotary encoder (not shown), and as the foreign object detecting unit 60 optically detects existence of a foreign object in the present embodiment, principle of detection and specific configuration of the detecting units are not limited to those described in the embodiment.

In the present embodiment, a configuration in which the sliding door 10 is slid by a manual operation is described as an example. However, the present invention may be applied to other configuration in which the sliding door 10 is slid by an actuator that is activated by operation of a door switch provided at driver seat, passenger seat, and door handle 16, or operation of a key. When the sliding door 10 is slid by the actuator, the slide stopping unit is preferably configured to invalidate door opening operation by the door switch itself. According to the sliding door apparatus employing such slide stopping unit, it is possible to securely prevent a foreign object existing in the open area of the window opening from being caught, and to avoid a possibility of confusing the driver or passenger.

Moreover, in the present embodiment, only when the window opening state detecting unit 50 detects whether the window opening 14 is open, the foreign object detecting unit 60 detects whether a foreign object exists. However, it is also enough to constantly detect whether a foreign object exists by the foreign object detecting unit 60 without employing the window opening state detecting unit 50.

Furthermore, although the foreign object detecting unit 60 detects existence of the foreign object only when the window opening 14 is not completely closed because the threshold of the window opening state detecting unit 50 is set to 0 millimeter, the threshold of the window opening state detecting unit 50 may be set to a value larger than 0 millimeter.

As described above, the sliding door apparatus according to the present invention activates the slide stopping unit only when the foreign object detecting unit detects the existence of a foreign object in the open area of the window opening. Even in a condition that the window is open, if there is no foreign object in the open area of the window opening, it is possible to slide the sliding door to the full-open position as is the usual case, so that usability of the sliding door apparatus is significantly improved.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A sliding door apparatus comprising:

a sliding door having a window and slidably disposed with respect to a body of a vehicle, the window having an opening/closing member that opens or closes the window to form an open area and a closed area in the window, the sliding door having a full-open position and an opening direction;

a foreign object detecting unit that detects whether a foreign object exists in the open area; and a slide stopping unit that stops, upon the foreign object detecting unit detecting existence of the foreign object in the open area, sliding of the sliding door in the opening direction before the sliding door reaches the full-open position.

2. The sliding door apparatus according to claim 1, wherein the opening/closing member is a window glass.

3. The sliding door apparatus according to claim 1, wherein the foreign object detecting unit includes an optical detector that optically detects the existence of the foreign object.

4. The sliding door apparatus according to claim 3, wherein the optical detector includes a light emitting unit that is arranged at one side of the window to emit light across the window; and a light detecting unit that is arranged at another side of the window to detect the light emitted.

5. The sliding door apparatus according to claim 1, wherein the slide stopping unit includes a stopping member that is pivotably provided on the sliding door, the stopping member having a retracted position and a protruded position; and an abutting portion that is provided on the body, wherein when the slide stopping unit is not activated, the stopper member is kept at the retracted position, and when the slide stopping unit is activated, the stopper is set to a protruded position for encountering the abutting portion.

6. The sliding door apparatus according to claim 1, wherein the slide door has an arrangement to open or close the slide door manually.

7. The sliding door apparatus according to claim 1, further comprising:

a door open/close switch that outputs a signal to open or close the slide door; and an electric actuator that drives the slide door based on the signal.

8. The sliding door apparatus according to claim 7, wherein upon the foreign object detecting unit detecting existence of the foreign object in the open area, the slide stopping unit provides a control on the door open/close switch in such a manner that the door open/close switch outputs a signal that indicates the slide door not to be opened.

9. The sliding door apparatus according to claim 1, further comprising a window state detecting unit that detects a width of the open area and outputs a detection signal when the width is more than a predetermined value, wherein upon receiving the detection signal, the foreign object detecting unit detects whether a foreign object exists in the open area.

10. The sliding door apparatus according to claim 9, wherein the predetermined value is zero millimeter.

11. The sliding door apparatus according to claim 1, wherein the foreign object detecting unit detects the foreign object before the foreign object is caught between the window and the body.

12. The sliding door apparatus according to claim 1, wherein a position of the slide stopping unit is set so that a predetermined safe distance is ensured between a front side frame of the window and a pillar of the body.

13. the sliding door apparatus according to claim 1, wherein the stopped sliding door is adapted to slide to the full-open position if the foreign object detecting unit detects that the detected foreign object is removed.

* * * * *